US005163268A

United States Patent [19]

Vaccari et al.

[11] Patent Number: 5,163,268

[45] Date of Patent: Nov. 17, 1992

[54] METHOD OF FEEDING AND FOLDING SHEET MATERIAL ON A PACKING MACHINE

[75] Inventors: Giorgio Vaccari; Antonio Gamberini, both of Bologna, Italy

[73] Assignee: G.D Societa' Per Azioni, Italy

[21] Appl. No.: 619,477

[22] Filed: Nov. 29, 1990

[30] Foreign Application Priority Data

Dec. 7, 1989 [IT] Italy ..... 3755 A/89

[51] Int. Cl.[5] ..... B65B 11/28; B65B 19/02

[52] U.S. Cl. ..... 53/397; 53/415; 53/466; 53/136.1; 53/234

[58] Field of Search ..... 53/410, 415, 466, 397, 53/135.1, 136.1, 234, 580, 207, 209, 389.3, 389.4

[56] References Cited

U.S. PATENT DOCUMENTS

| | | | |
|---|---|---|---|
| 1,337,778 | 4/1920 | Leonard | 53/389.3 |
| 4,004,395 | 1/1977 | Bardenhagen | 53/389.3 |
| 4,596,112 | 6/1986 | Buckley | 53/234 X |
| 4,866,912 | 9/1989 | Deutsch | 53/234 X |
| 4,918,901 | 4/1990 | Gamberini | 53/234 |
| 5,035,102 | 7/1991 | Tomanovits | 53/397 |

*Primary Examiner*—John Sipos

*Attorney, Agent, or Firm*—Marshall, O'Toole, Gerstein, Murray & Bicknell

[57] ABSTRACT

A method of feeding and folding sheet material on a flip-top cigarette packing machine, whereby a wrapping wheel on the wrapping line of the packing machine is connected to a supply device whereby flat portions of sheet material, from which to form internal collars and, if necessary, coupons, are fed successively to the wrapping wheel and into contact with the outer surface of respective groups of cigarettes already present on the wheel; the collars being formed by folding the flat portions of sheet material about respective groups as these are transferred to a further wrapping wheel on the wrapping line.

6 Claims, 3 Drawing Sheets

METHOD OF FEEDING AND FOLDING SHEET MATERIAL ON A PACKING MACHINE

BACKGROUND OF THE INVENTION

The present invention relates to a method of feeding and folding sheet material on a packing machine.

In particular, the present invention relates to a method of feeding and folding, on the wrapping line of a packing machine, sheet material for the formation of strengthening collars for flip-top cigarette packets and, if required, also coupons inserted inside the packets.

Flip-top cigarette packets usually comprise a strengthening element or collar over the inside foil wrapping and extending along the edges of the opening closed by the lid.

Known flip-top packing machines employ a collar feeding device connected to a wheel on the wrapping line of the machine, which wheel usually presents seats for receiving respective groups of foil-wrapped cigarettes as well as respective collars.

On known packing machines, the collars are usually formed by folding, substantially in the form of a U, flat portions of sheet material as these are fed along a line to the packing machine. Once formed, the collars are inserted inside respective seats on the wrapping line wheel prior to inserting the foil-wrapped cigarettes. The above method obviously involves the use of numerous relatively complex, high-cost mechanical devices, such as folding elements on the outside of the wrapping wheel, and gripping elements for each seat on the wrapping line wheel for retaining the collar in such a position inside the wheel as to enable subsequent insertion of the foil-wrapped cigarettes.

SUMMARY OF THE INVENTION

The aim of the present invention is to provide a method of feeding and folding sheet material on a packing machine, particularly for the formation of strengthening collars, which method provides for drastically simplifying the design of the wrapping line on the machine, while at the same time improving performance and reliability.

With this aim in view, according to the present invention, there is provided a method of feeding and folding sheet material on a flip-top cigarette packing machine, said sheet material comprising at least first flat portions from which to form inner strengthening collars for said packets; characterised by the fact that it comprises stages consisting in: successively feeding groups of cigarettes inside respective first seats of a first wheel on the wrapping line of said packing machine; rotating said first wheel about its axis, for feeding each said group and said respective first seat through a station wherein said first flat portions are loaded; feeding said first flat portions on to a lateral surface of said respective groups in said loading station, each said first flat portion being fed in such a manner as to present two end portions projecting outwards of said lateral surface; transferring each said group and respective said first flat portion from said loading station to a transfer station wherein said group is transferred to a respective second seat of a second wrapping wheel facing said lateral surface of said groups; extracting each said group from said respective first seat perpendicularly to said lateral surface, and inserting said group inside said respective second seat, so as to fold said respective first flat portion in a U about said group and so form said collar.

The above method provides for eliminating, on the wrapping line of the packing machine, all the devices formerly required for folding the flat portions and forming the collars, and for inserting and retaining the collars inside the respective seats pending insertion of the cigarette groups.

Said first flat portions are preferably fed to said loading station along a first line comprising an output device consisting of a supply wheel turning about an axis perpendicular to the axis of rotation of said first wheel, said supply wheel being tangent to said first wheel in said loading station and facing said lateral surface of said groups.

The line supplying said first flat portions may thus be arranged parallel to the wrapping line of the packing machine, thus drastically reducing the size of the packing machine and enabling the elimination of devices normally featured on known packing machines for rotating and correctly positioning the flat portions prior to being fed on to the first wrapping wheel.

The above method preferably also comprises a further stage consisting in feeding each said first flat portion to said loading station together with a respective second flat portion consisting of a coupon; said second flat portion being superimposed on said respective first flat portion, and being fed directly on to said lateral surface of said respective group.

Said second flat portions are preferably fed to said loading station along a second line sharing said supply wheel with said first line.

The same wrapping wheel on the wrapping line of the packing machine and the same loading station may thus be used for supplying both the collars and the coupons.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
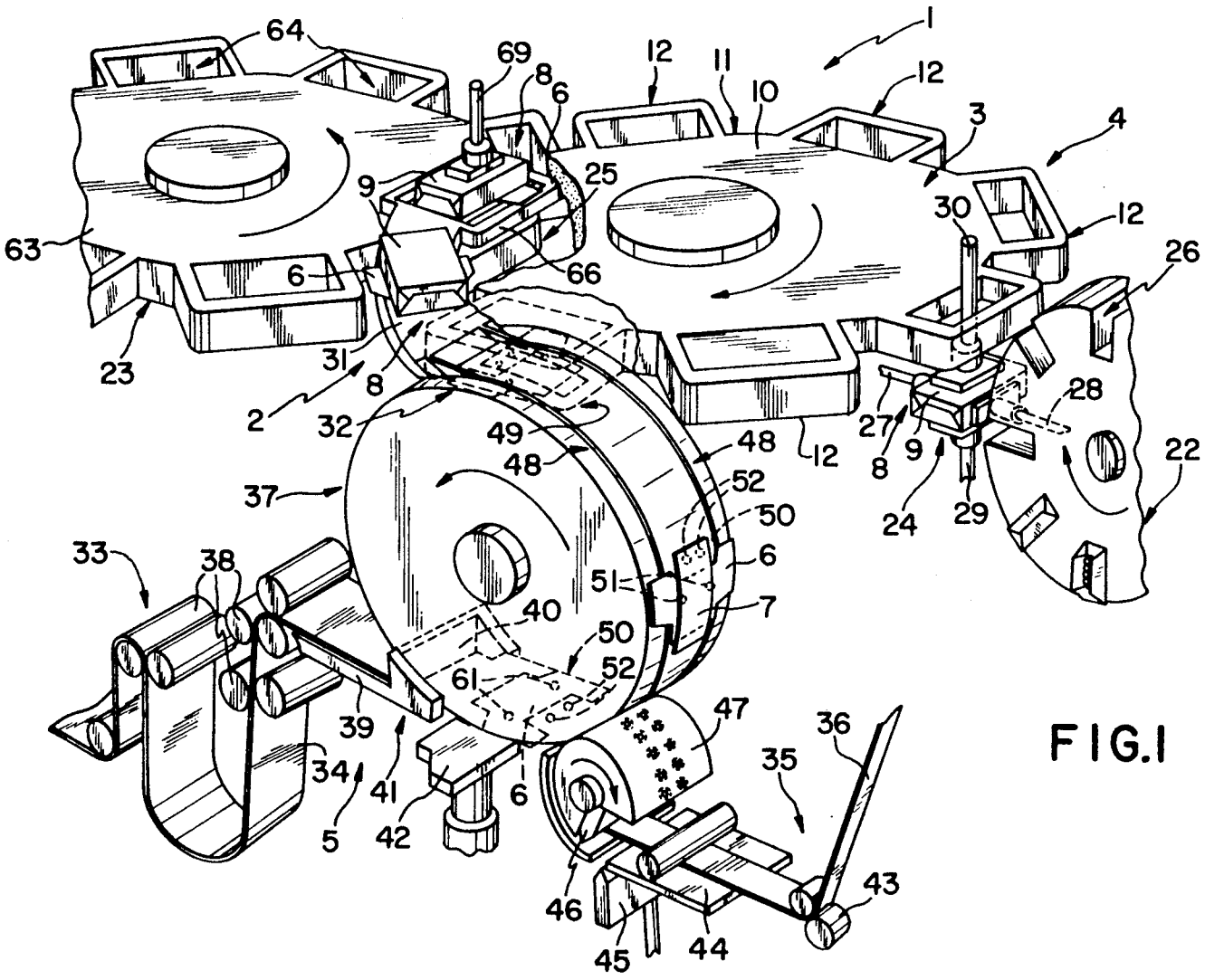
FIG. 1 shows a partially-sectioned, schematic view in perspective, with parts removed for simplicity, of a feeding and folding device implementing the method according to the present invention.

Number 1 in FIG. 1 indicates a flip-top cigarette packing machine.

Machine 1 comprises a feeding and folding unit 2 in turn comprising a wheel 3, forming part of the wrapping line 4 of machine 1, and a supply device 5 whereby portions 6 and 7 of sheet material from which to form parts of said packets (in the example shown, an inner collar 6*a* (FIG. 3) and possibly also a coupon) are fed to wheel 3 and on to the outer surface of a group 8 previously formed on line 4 and consisting of a number of cigarettes (not shown) enclosed inside a foil wrapping 9 in the form of a rectangular parallelepipedon.

As shown in FIG. 1, wheel 3 comprises a substantially horizontal central disc 10 jogged (clockwise in FIG. 1) about a substantially vertical axis.

Figure 2:
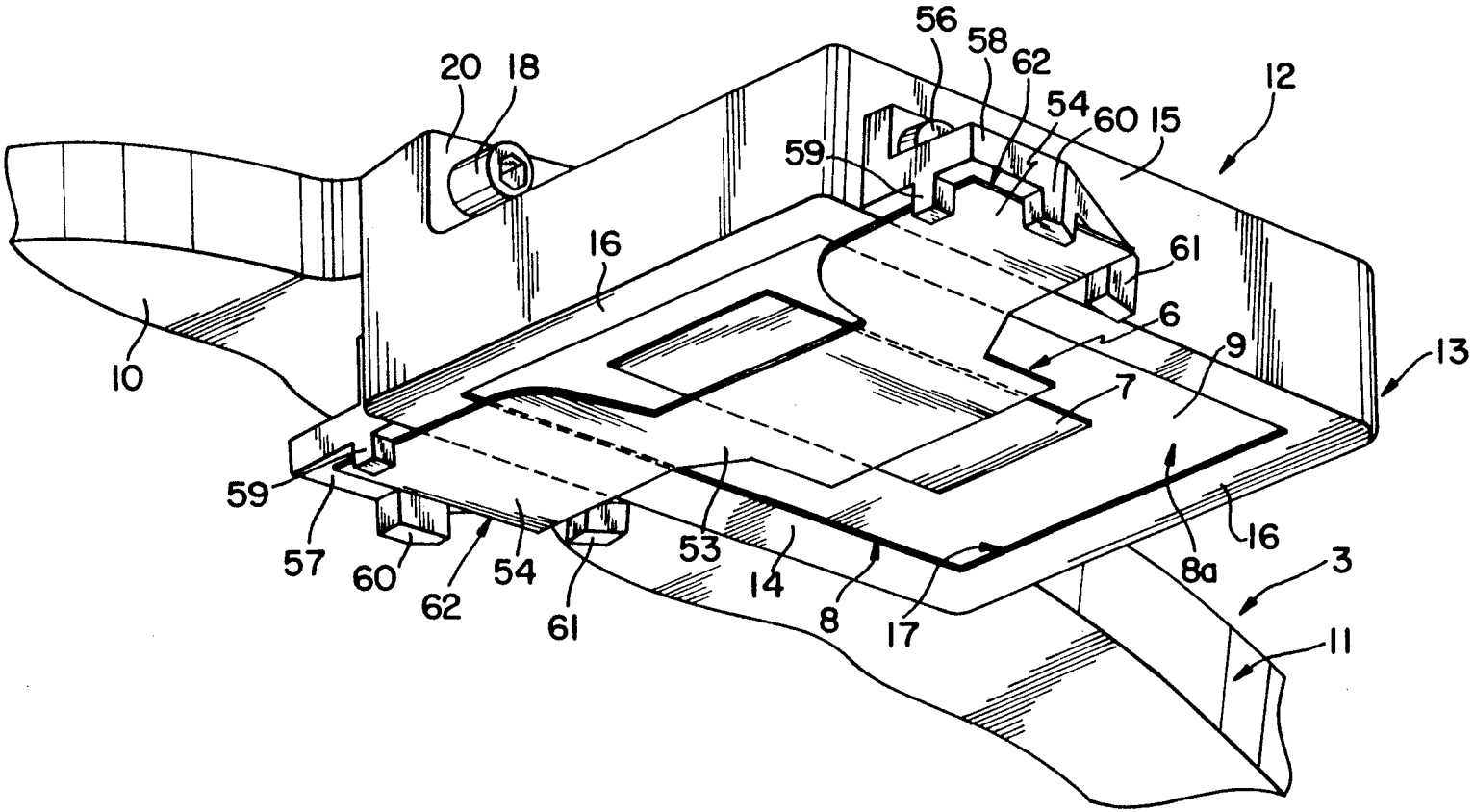
FIG. 2 shows a larger-scale underside view in perspective of a detail in FIG. 1 in a first operating position.
Figure 3:
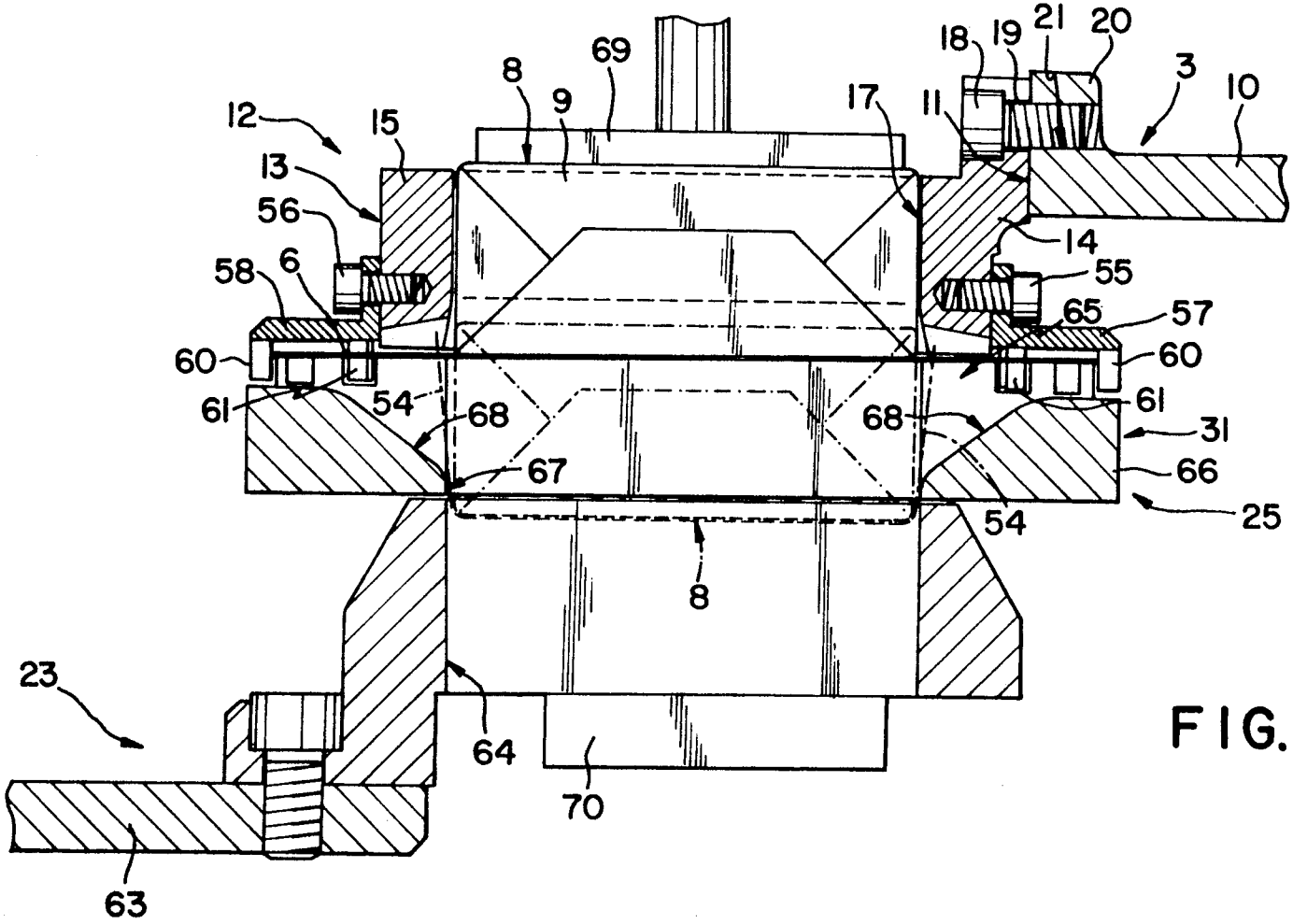
FIG. 3 shows a section of the FIG. 2 detail in a second operating position.

As shown in FIGS. 2 and 3, disc 10 presents a peripheral outer surface 11 on which are formed a number of equally spaced radial appendixes 12, each consisting of a substantially rectangular frame 13 comprising two longitudinal arms 14 and 15 joined at opposite ends by cross members 16 extending substantially radially in relation to disc 10. Each frame 13 defines a through opening or pocket 17 of substantially the same shape and size as the longer outer lateral surface of group 8, and is located beneath disc 10 to which it is connected by radial screws 18 fitted through respective holes 19 formed in a rib 20 extending upwards from longitudinal arm 14, and through respective threaded holes 21 (FIG. 3) formed in surface 11.

Wheel 3 is powered so as to jog in steps equal to the spacing of pockets 17 on disc 10.

On wrapping line 4, wheel 3 cooperates with an input drum 22 at an input station 24, and with an output wheel 23 at a transfer station 25, for loading and transferring diametrically-opposed groups 8 on wheel 3. In particular, input drum 22 is mounted so as to jog about a horizontal axis, and presents a number of outer radial pockets 26, each designed to receive a group 8 with its longer lateral surfaces arranged radially in relation to drum 22.

Input station 24, which is of known design as regards cigarette packing machines and therefore only described briefly, comprises a horizontal radial pusher 27 designed to cooperate with a horizontal radial pusher 28 on drum 22 for successively extracting groups 8 from respective pockets 26 in station 24, and feeding them underneath respective pockets 17 as these stop in station 24. Station 24 also comprises two coaxial, vertically-operating pushers 29 and 30 for receiving groups 8 extracted by pushers 27 and 28 from pockets 26, and feeding them inside pockets 17 on wheel 3 with their longer lateral surfaces arranged horizontally.

As shown in FIG. 1, wrapping line 4 comprises a fixed curved plate 31 (shown only partially for reasons described in detail later on) extending beneath the path of appendixes 12 between station 24 and 25, for retaining groups 8 inside respective pockets 17. At a station 32 wherein portions 6 and coupons 7 (if any) are loaded, plate 31 is divided into two portions, the first of which (not shown) extends between stations 24 and 32, and the second from station 32 to beyond station 25.

As shown in FIG. 1, supply device 5 is located beneath wheel 3 so as to cooperate with the same in loading station 32, and comprises a first and second line 33 and 35 respectively supplying continuous strips 34 and 36, said lines 33 and 35 being arranged opposite each other and substantially tangent to respective points on the periphery of a supply wheel 37 which acts as the output element for both lines 33 and 35. Wheel 37 is located between lines 33 and 35 and wheel 3, and turns (anticlockwise in FIG. 1) about an axis extending radially beneath wheel 3 and perpendicular to lines 33 and 35.

Strip 34 consists of cardboard or similar, and is cut successively into portions 6 from which to form collars 6*a*. For this purpose, line 33 comprises a number of feed units 38 for feeding strip 34 on to a sliding surface 39 substantially tangent to wheel 37, and beneath a fixed shaped blade 40 supported on surface 39 and extending across one end of the same. Fixed blade 40 forms part of a known cutting unit 41 also comprising a cutting block 42 designed to move to and from fixed blade 40 for successively cutting portions 6 off the end of strip 34 fed by units 38 beneath and in contact with the periphery of wheel 37.

Strip 36 consists of paper or similar, and is cut successively into coupons 7. For this purpose, line 36 comprises a number of feed units 43 for feeding strip 36 on to a sliding surface 44 substantially aligned with surface 39, and over a transverse blade 45 cooperating with a mobile blade 46 for cutting coupons 7 off the end of strip 36. Blade 46 is supported on a suction roller 47 tangent to a point on wheel 37 downstream from the point of tangency with surface 39, in relation to the rotation direction of wheel 37, and designed to successively feed coupons 7 on to the periphery of wheel 37, over respective collars 6*a*.

At loading station 32, wheel 37 is substantially tangent to the lower surface of appendixes 12 on wheel 3, and is defined externally by a cylindrical surface having a concave cross section defined by two coaxial cylindrical end surfaces 48 of the same radius, and by an intermediate cylindrical surface 49 coaxial with surfaces 48 but of a smaller radius. About surface 49, wheel 37 presents a number of equally spaced suction devices 50, each comprising a first pair of holes 51 aligned along a first generating line of surface 49 and close to the opposite longitudinal ends of the same, and a second pair of holes 52 closer together than holes 51 and aligned along a second generating line of surface 49 to the front of said first generating line in the rotation direction of wheel 37.

As shown in FIG. 1, each portion 6 comprises a central body 53 (FIG. 2) from the opposite sides of which two wings 54 extend laterally outwards. Once cut off strip 34 by cutting unit 41, each portion 6 is sucked on to the periphery of wheel 37 by a respective pair of holes 51, which grip body 53 on to surface 49 and wings 54 on to respective surfaces 48. As surfaces 48 are raised in relation to surface 49, each portion 6 on wheel 37 assumes a curved configuration with its concave side facing outwards of wheel 37.

As portion 6 is fed towards loading station 32, a coupon 7 is superimposed, if necessary, over the same. Coupon 7 is narrower than surface 49 and is held on to wheel 37, as it travels towards loading station 32, by a respective pair of holes 52, which hold the front end of coupon 7 on to surface 49, while the remainder is allowed to hang freely over body 53 of portion 6.

In loading station 32, each pair 6–7 is released (as shown in FIG. 2) on to the lower lateral surface 8*a* of group 8 located inside pocket 17 in station 32, and is fed by wheel 3, on the upper surface of plate 31, to output station 25.

In connection with the above, it should be pointed out that wheel 37 may be jogged or rotated continuously. If jogged (FIG. 1), each pair 6–7 is transferred from wheel 37 to wheel 3 as each pocket 17 stops in loading station 32. If rotated continuously (not shown), transfer is effected as pocket 17 travels through loading station 32 and between two successive stops of wheel 3. In the case of continuous rotation, cutting unit 41 is, of course, replaced by a cutting roller unit of the type used on line 35.

In the FIG. 2 configuration, portion 6 presents central body 53 contacting lower surface 8*a* of unit 8, so as to retain coupon 7, and wings 54 extend beneath and outwards of respective arms 14 and 15 of frame 13. To retain portion 6 in the above position, arms 14 and 15 of each frame 13 are fitted, by means of respective screws 55 and 56, with retaining devices consisting respectively of flat outer lateral appendixes 57 and 58 substantially aligned along the same radius of disc 10. From the lower surface of each appendix 57 and 58, substantially coplanar with the lower surface of respective frame 13, there extend downwards three pins 59, 60 and 61 arranged in such a manner as to define a seat or housing for a respective wing 54, the outer edge of which engages in slightly forced manner the inner surface of pins 59 and 61 and particularly pin 60, which cooperates with the outer lateral edge 62 of wing 54, and is separated from pin 60 on the other appendix 57, 58 by a distance slightly less than that between two edges 62 of portion 6.

In connection with the above, it should be pointed out that, as already stated, each portion 6 is fed by wheel 37 to loading station 32 in a slightly curved position, which enables edges 62 to fit between and into contact with respective pins 60 when the suction through holes 51 is cut off in known manner, for transferring portion 6 from wheel 37 to wheel 3.

In addition or by way of an alternative to pins 59, 60 and 61, appendixes 57 and 58 may of course be provided with a number of suction holes (not shown) connected to a suction source (not shown) for holding wings 54 on to appendixes 57 and 58.

As shown in FIGS. 1 and 3, wheel 23 presents the same design as wheel 3, and consists of a disc 63 having a number of peripheral pockets 64 of the same shape, size and spacing as pockets 17. Wheel 23 is jogged anticlockwise (in FIG. 1) and so timed with wheel 3 that a pocket 64 stops simultaneously underneath a pocket 17 in station 25. As shown in FIG. 3, pocket 64 is arranged coaxial with pocket 17 with which it communicates via a tapered passage 65 formed through a wider end portion 66 of plate 31 between wheels 3 and 23.

Passage 65 presents an outlet 67 facing wheel 23 and of the same shape and size as the cross section of pockets 17 and 64; and an inlet which, transversely in relation to plate 31 and radially in relation to wheels 3 and 23, is larger than pockets 17 and 64 and slightly smaller than the distance between edges 62 of portion 6. The lateral edges of said input of passage 65, located perpendicular to a plane (not shown) through the axes of rotation of wheels 3 and 23, blend with the corresponding edges of outlet 67 via respective substantially flat, downward-converging, inclined surfaces 68.

Station 25 comprises a pusher 69 designed to move vertically through a pocket 17 in station 25, and through passage 65 to and from a curved horizontal plate 70 similar to plate 31 and extending beneath part of the route travelled by pockets 64 on wheel 23.

Consequently, when a group 8 stops in station 25 with portion 6 arranged flat, contacting the upper surface of plate 31 and over the inlet of passage 65, downward operation of pusher 69 in the direction of plate 70 expels group 8 from pocket 17 perpendicularly to surface 8*a*; group 8 is engaged through passage 65; and wings 54 slide over inclined surfaces 68 and are gradually folded upwards on to respective lateral surfaces of wrapping 9 for forming collar 6*a*. As shown in FIG. 3, upward folding of wings 54 about wrapping 9 and, consequently, the formation of collar 6*a*, are completed when group 8 and collar 6*a* are engaged by pusher 69 inside a pocket 64 underneath outlet 67 of passage 65. Said folding pattern is of course due solely to the design of surfaces 68, which may be varied for providing for different folds. In other words, by virtue of the thrust exerted by pusher 69, group 8 acts as a folding spindle for folding portion 6 about respective wrapping 9 as group 8 is transferred from pocket 17 on to plate 70 of pocket 64, and prior to being carried off by wheel 23.

I claim:

1. A method of feeding and folding sheet material on a flip-top cigarette packing machine, said sheet material comprising at least first flat portions (6) from which to form inner strengthening collars (6*a*) for said packets; characterized by the fact that is comprises stages consisting in: successively feeding groups (8) of cigarettes inside respective first seats (17) within appendixes (12) of a first wheel (3) on the wrapping line (4) of said packing machine (1); rotating said first wheel (3) about its axis, for feeding each said group (8) and said respective first seat (17) through a station (32) wherein said first flat portions (6) are loaded; feeding said first flat portions (6) from a supply wheel (37) on to a lateral surface (8*a*) of said respective groups (8) in said loading station (32), said supply wheel (37) being tangent to a surface of said appendixes (12) at said loading station (32) and facing said lateral surface (8*a*) of said groups (8), said surface of said appendixes (12) being oriented perpendicular to the axis of rotation of said first wheel (3), each said first flat portion (6) being fed in such a manner as to present two end portions (54) projecting outwards of said lateral surface (8*a*); transferring each said group (8) and respective said first flat portion (6) from said loading station (32) to a transfer station (25) wherein said group (8) is transferred to a respective second seat (64) of a second wrapping wheel (23) facing said lateral surface (8*a*) of said groups (8); extracting each said group (8) from said respective first seat (17) perpendicularly to said lateral surface (8*a*), and inserting said group (8) inside said respective second seat (64), so as to fold said respective first flat portion (6) in a U about said group (8) and so form said collar (6*a*).

2. A method as claimed in claim 1, wherein said supply wheel (37) turns about an axis perpendicular to the axis of rotation of said first wheel (3).

3. A method as claimed in claim 2, characterised by the fact that it also comprises a further stage consisting in feeding each said first flat portion (6) to said loading station (32) together with a respective second flat portion (7) in the form of a coupon; said second flat portion (7) being superimposed on said respective first flat portion (6) and being fed into direct contact with said lateral surface (8*a*) of said group (8).

4. A method as claimed in claim 3, characterised by the fact that said second flat portions (7) are fed to said loading station (32) on a second line (35) sharing said supply wheel (37) with said first line (33).

5. A method as claimed in claim 2, characterised by the fact that said supply wheel (37) presents a concave annular outer surface having suction means (51); said first flat portions (6) being fed successively to said supply wheel (37) and being curved by said suction means (51) on to said concave surface, so as to be fed, so curved, to said loading station (32).

6. A method as claimed in claim 5, characterised by the fact that it comprises a further stage consisting in de-activating said suction means (51) upon said first flat portion (6) reaching said loading station (32), thus enabling said first portion (6) to return to its undeformed position and engage respective retaining means (59, 60, 61) on said first wrapping wheel (3).

* * * * *